US009284907B2

(12) United States Patent
Yamaguchi et al.

(10) Patent No.: US 9,284,907 B2
(45) Date of Patent: Mar. 15, 2016

(54) FUEL PUMP CONTROL APPARATUS OF ENGINE

(75) Inventors: Yohei Yamaguchi, Kobe (JP); Yasuhiko Ishida, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 1006 days.

(21) Appl. No.: 13/273,764

(22) Filed: Oct. 14, 2011

(65) Prior Publication Data

US 2012/0291754 A1 Nov. 22, 2012

(30) Foreign Application Priority Data

May 19, 2011 (JP) ..... 2011-112264

(51) Int. Cl.
*F02D 41/30* (2006.01)
*F02D 41/24* (2006.01)
*F02D 41/20* (2006.01)

(52) U.S. Cl.
CPC ..... *F02D 41/3082* (2013.01); *F02D 41/2464* (2013.01); *F02D 2041/2027* (2013.01)

(58) Field of Classification Search
CPC ..... F02D 41/2464; F02D 41/3082; F02D 2041/2027; F02M 37/12; F16K 31/20; B60K 15/077
See application file for complete search history.

(56) References Cited

U.S. PATENT DOCUMENTS 5,505,180 A * 4/1996 Otterman ..... F05D 41/2464 123/497
5,723,780 A * 3/1998 Miwa et al. ..... 73/114.43
5,816,221 A * 10/1998 Krueger ..... 123/491
5,850,818 A * 12/1998 Yoshiume et al. ..... 123/497
6,082,329 A * 7/2000 Kazumasa ..... 123/339.18
6,125,832 A * 10/2000 Toyohara et al. ..... 123/690
6,581,574 B1 * 6/2003 Moran et al. ..... 123/497
7,627,407 B2 * 12/2009 Hirooka ..... 701/34.4
8,527,182 B2 * 9/2013 Minami et al. ..... 701/103

(Continued)

FOREIGN PATENT DOCUMENTS

JP 11036942 2/1999
JP 3650522 B2 5/2005

(Continued)

OTHER PUBLICATIONS

Reference Yokoi (JP 11-036942), Fuel Supply System of Internal Combustion Engine, Sep. 2, 1999 Machine Translation.*

(Continued)

*Primary Examiner* — Hung Q Nguyen
*Assistant Examiner* — Brian P Monahon
(74) *Attorney, Agent, or Firm* — Sughrue Mion, PLLC; Richard C. Turner

(57) ABSTRACT

By driving a fuel pump suitably to an amount of fuel according to an amount of fuel consumed by an engine and by monitoring an actual motor speed of the fuel pump, F/B control is carried out according to a target motor speed and the actual motor speed of the fuel pump. Meanwhile, by learning and storing a duty value comparable to a deviation between the target and actual motor speeds, duty driving of the fuel pump is corrected to suit an engine condition. It thus becomes possible to provide a fuel pump control apparatus of an engine capable of promoting power saving by suppressing a wasteful energy loss including a current consumption and making an internal circuit of an ECU simpler by enhancing fuel supply accuracy.

2 Claims, 9 Drawing Sheets

(56) References Cited

U.S. PATENT DOCUMENTS

| | | | | |
|---|---|---|---|---|
| 2005/0103301 | A1* | 5/2005 | Namari et al. | 123/179.3 |
| 2007/0006849 | A1* | 1/2007 | Mashiki | 123/457 |
| 2007/0215115 | A1* | 9/2007 | Hazama | 123/458 |
| 2009/0063015 | A1* | 3/2009 | Tokugawa et al. | 701/103 |
| 2010/0116253 | A1* | 5/2010 | Furuhashi et al. | 123/495 |
| 2010/0116361 | A1* | 5/2010 | Furuhashi | B60K 15/077 137/398 |
| 2013/0340698 | A1* | 12/2013 | Provost | 123/179.5 |
| 2014/0069362 | A1* | 3/2014 | Hirata | 123/90.17 |

FOREIGN PATENT DOCUMENTS

| | | | | |
|---|---|---|---|---|
| JP | 2008121594 | A | * | 5/2008 |
| JP | 2008128034 | A | | 6/2008 |
| JP | 4155168 | B2 | | 9/2008 |
| JP | 2010112320 | A | | 5/2010 |

OTHER PUBLICATIONS

Japanese Office Action issued Jan. 29, 2013, in Japanese Patent Application No. 2011-112264.

* cited by examiner

FUEL PUMP CHARACTERISTICS DATA (ROTATION SPEED/FUEL)

F/B CORRECTION AND I-GAIN MAP DATA

FUEL PUMP CONTROL APPARATUS OF ENGINE

BACKGROUND OF THE INVENTION

1. Field of the Invention

The present invention relates to a fuel pump control apparatus of an engine, and more particularly, to a fuel pump control apparatus of an engine for small outboard motor unfurnished with a battery and getting the engine started by manually rotating a crank shaft.

2. Background Art

For an outboard motor for small boat having a relatively small displacement, a carburetor system is the mainstream of a fuel supply. An outboard motor adopts a device configuration furnished with neither a battery nor a starter and thereby getting the engine started by a manual operation of a ship operator using a recoil starting device, that is, a typical outboard motor is relatively lightweight and gets the engine started at a low cost. However, with the aim of enhancing ease of operation and maintenance, emission control, and output performance, shifting from the carburetor system to an FI (Fuel Injection) system is taking place for a fuel supply in an outboard motor for small boat having a small displacement.

Even in such a case, an outboard motor is often furnished with neither a starting device, such as a starter, nor a battery to form a compact and light engine at a low cost. The outboard motor uses injectors that supply the engine with a fuel, a fuel pump, a fuel pressure regulator that maintains a fuel pressure at a certain pressure, a sensor that detects an operation condition of the engine, and an ECU (Electronic Control Unit) as a controller that carries out fuel control. Also, the outboard motor is furnished with a power generator that supplies these components with power and thereby supplies the engine with a fuel by activating the ECU and the injectors on the power from the power generator while the engine is driven.

Meanwhile, there is a strong demand for power saving arising from environmental issues, such as global warming, and it becomes necessary to drive a fuel pump in an efficient manner such that suppresses an energy loss (current consumption and fuel heat generation). To this end, there is proposed a fuel supply apparatus (see Patent Document 1) configured to control a fuel pressure supplied to the injectors to be maintained at a required target value by carrying out feedback (F/B) control on a driving current of a fuel pump from the viewpoint of efficiently supplying the engine with a minimum amount of fuel close to an amount of fuel the engine requires by enhancing fuel supply accuracy of the fuel pump.

According to the method proposed in Patent Document 1, in order to enhance a response in transition when the target value of the fuel pressure is changed, an amount of fuel to be supplied to the engine is calculated on the basis of a rotation speed and a load condition of the engine and a driving current is controlled to temporarily exceed the changed target current value in the changed direction. Accordingly, because a larger driving amount has to be provided to the fuel pump, a wasteful loss occurs in current consumption and a self-generated voltage is consumed considerably. The proposed method therefore has a problem that it does not match up with the demand of power saving.

In addition, because an amount of fuel to be supplied to the engine by the fuel pump is determined according to data pre-set in the ECU, it is difficult to adjust an amount of fuel by quickly responding to irregularities among parts involved with an actuator and a change of the engine condition. Hence, accuracy above a certain degree cannot be achieved with a unique map value. Further, because a current obtained by power generation is consumed by a load on the fuel pump when a larger driving amount than is essentially necessary is set in driving duty data, the power generator attached to the fuel supply apparatus has to have a large generation capacity.

Moreover, a temperature of the motor itself rises due to current consumption by the fuel pump and the parts undergo a temperature-induced drift. This results in a problem that even when the fuel pump is driven by the same driving amount, because motor rotations differ from pump characteristics of the driving duty, the same result cannot be obtained.

In a case where the fuel pump apparatus is used for another engine having a different displacement, data on the fuel pump driving duty is set on the basis of an amount of fuel the engine requires together with the driving characteristics of the fuel pump. In this case, it is necessary to set the data system by system and there arises a problem that man-hours are increased to make fuel pump apparatus available for another engine.

Patent Document 1: JP-A-11-247695

SUMMARY OF THE INVENTION

The invention was devised to solve the problems discussed above and has an object to provide a fuel pump control apparatus of an engine that promotes power saving by suppressing current consumption by optimally controlling fuel pump driving duty for a proper amount of fuel to be supplied to an engine according to an amount of fuel consumption corresponding to an operation condition of the engine instead of performing F/B control on a fuel pump driving current and makes an internal circuit of an ECU simpler by enhancing fuel supply accuracy.

A fuel pump control apparatus of an engine according to an aspect of the invention includes: an operation condition detection portion that detects an operation condition of the engine; a motorized fuel pump furnished with a fuel pressure regulation function; an injector that supplies the engine with a fuel according to a fuel pressure supplied from the fuel pump; a power generation portion that generates power by manual rotational driving of a crank shaft of the engine; and a control portion that is activated by a voltage generated by the power generation portion and computes an amount of fuel to be injected and calculates fuel pump driving duty according to a detected value from the operation condition detection portion. The control portion includes: an injector injection amount calculation functioning portion that calculates an amount of injector injection to be supplied to the engine according to the operation condition of the engine; a fuel consumption amount calculation functioning portion that calculates an amount of fuel consumption the engine is consuming on the basis of the amount of injector injection, the number of cylinders, and an engine rotation speed; a pump driving fuel amount calculation functioning portion that calculates an amount of fuel to drive a pump on the basis of an output of the fuel consumption amount calculation functioning portion; a target motor speed calculation functioning portion that calculates a target motor speed on the basis of an output of the pump driving fuel amount calculation functioning portion; a driving duty calculation functioning portion that calculates duty according to which to drive the pump on the basis of an output of the target motor speed calculation functioning portion; and an F/B correction value calculation functioning portion that finds a deviation between an actual motor speed detected from the fuel pump and the target motor speed and calculates an F/B correction value of the driving duty so that the deviation is eliminated.

According to the invention, a pump driving amount, the target motor speed, and the driving duty are determined on the basis of an amount of fuel consumption. Accordingly, by separately setting two different characteristics: engine characteristics that define an amount of required fuel and fuel pump characteristics that define fuel pump driving duty data according to which to regulate a driving amount of the fuel pump required to achieve an amount of fuel the engine consumes, data on an engine ECU and data on a fuel pump actuator can be isolated. Hence, by performing the matching once, the fuel pump can be driven correspondingly to an amount of fuel the engine essentially requires. It thus becomes possible to reduce wasteful energy and an evaporation gas by suppressing excessive pump driving, which in turn makes it possible to achieve suitable and stable driving of the fuel pump.

Also, by carrying out F/B control according to speed data, which is a deviation between the target motor speed and the actual motor speed, when the driving duty is determined, irregularities among parts involved with the engine and the actuator can be absorbed. It thus becomes possible to achieve a fuel pump control apparatus capable of reducing wasteful energy by suppressing excessive pump driving and therefore suitable for saving power.

The foregoing and other object, features, aspects, and advantages of the present invention will become more apparent from the following detailed description of the present invention when taken conjunction with the accompanying drawings.

DESCRIPTION OF THE PREFERRED EMBODIMENT

Hereinafter, a specific embodiment of the invention will be described with reference to the drawings.

First Embodiment

Figure 1:
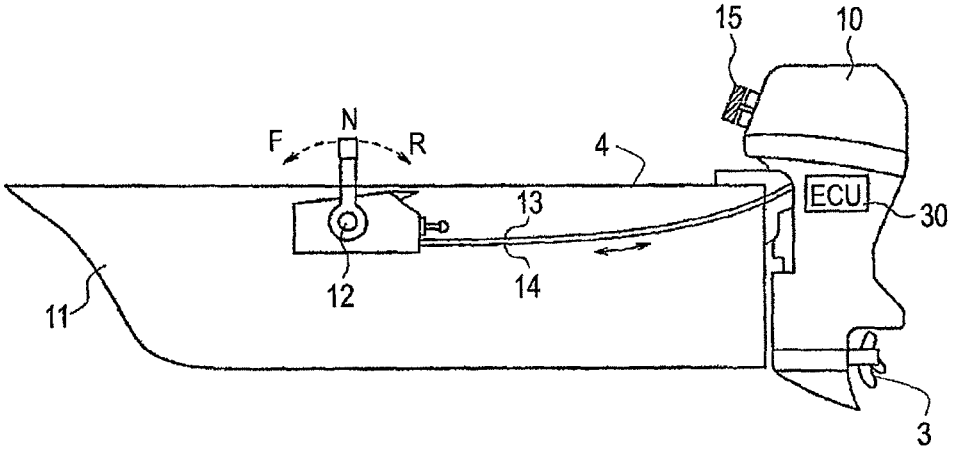
FIG. 1 is a view showing the overall configuration when the invention is applied to an internal combustion engine for ship.

FIG. 1 is a view showing the overall configuration when the invention is applied to an internal combustion engine for ship. An outboard motor 10 having an internal combustion engine (hereinafter, referred to as the engine), a shaft, and a propeller 3 provided integrally in one unit includes an ECU (Electronic Control Unit) 30 as a controller and is attached at the stern of a ship (small boat) 11.

A throttle lever 12 is disposed at a pilot seat 4. The throttle lever 12 regulates an amount of aperture of a throttle valve (an amount of intake air) by way of a link mechanism (not shown) in the outboard motor 10 via a throttle cable 13. The throttle lever 12 also sets a shift position (forward/neutral/reverse) by way of a shift link mechanism and a gear mechanism (neither is shown) in the outboard motor 10 via a shift cable 14. A recoil starting device 15 that gets the engine started manually is attached to the outboard motor 10. The engine furnished with neither a battery nor a starter can be started by manually pulling the recoil starting device 15 to rotate a crank shaft.

Figure 2:
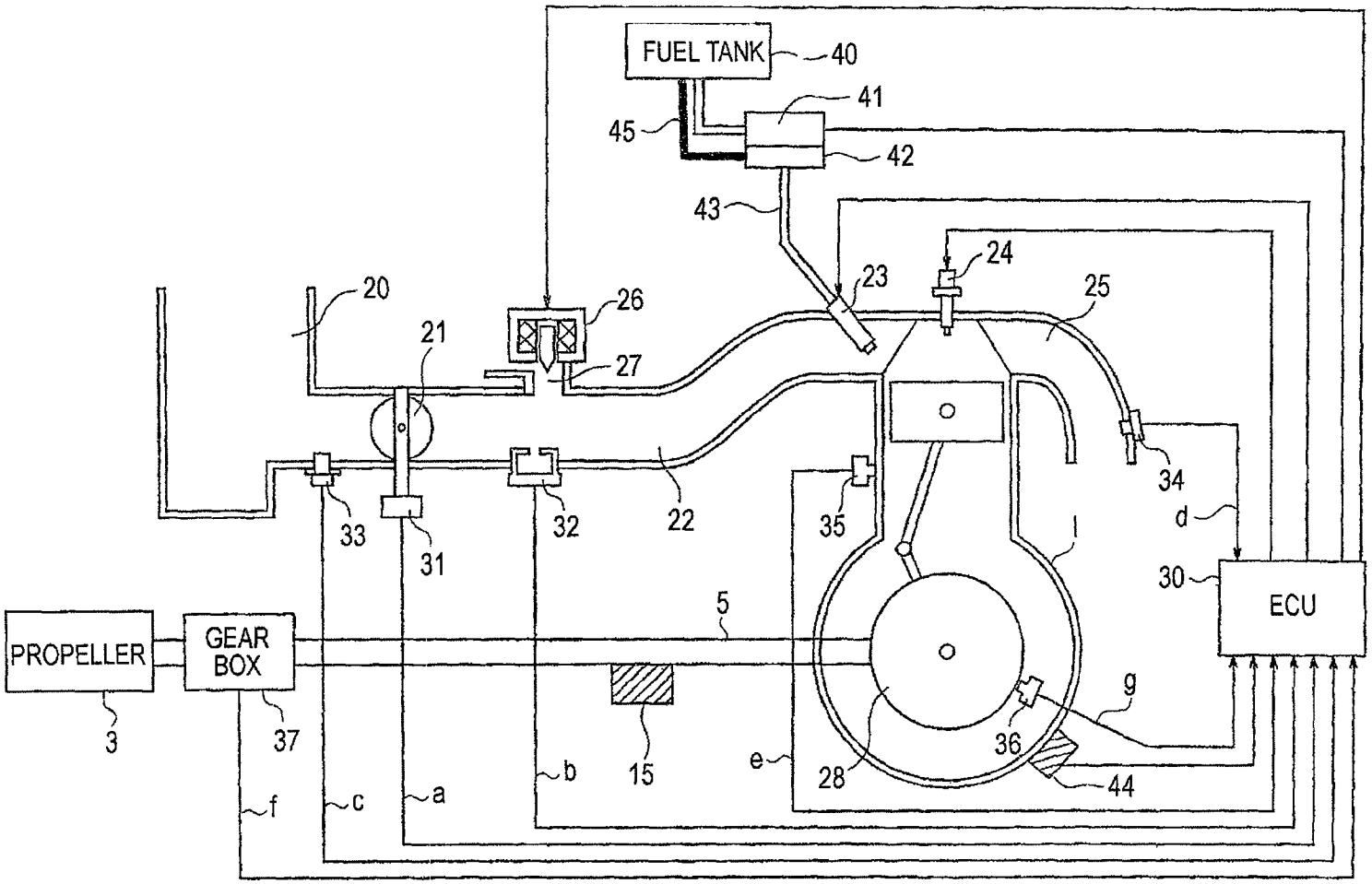
FIG. 2 is a view schematically showing a fuel injection control apparatus of the internal combustion engine according to a first embodiment of the invention.

FIG. 2 is a view schematically showing a fuel injection control apparatus of the internal combustion engine of FIG. 1. Referring to FIG. 2, the engine 1 takes air in via an inlet pipe 20 and intake air flows into an intake manifold 22 while a flow rate thereof is regulated via a throttle valve 21. An injector 23 is disposed immediately before a combustion chamber of the intake manifold 22 and injects a gasoline fuel. The intake air is mixed with the injected gasoline fuel to form an air-fuel mixture. The air-fuel mixture flows into the combustion chamber for each of a plurality of cylinders and burns upon ignition by a spark plug 24. An exhaust gas after combustion flows through an exhaust manifold 25 to be released to the outside of the engine 1.

Connected to the throttle valve 21 is a throttle aperture sensor 31 as an idle operation condition detector that detects an idle operation condition of the engine 1 and the throttle aperture sensor 31 outputs a signal proportional to the throttle aperture to the ECU 30 through a signal line a. Whether the engine 1 is in an idle condition is detected by determining whether the throttle valve 21 is fully closed according to the throttle opening signal. An absolute pressure sensor 32 is disposed downstream of the throttle valve 21 and outputs a signal corresponding to an inlet pipe absolute pressure PB (engine load) to the ECU 30 through a signal line b. An intake air temperature sensor 33 is disposed upstream of the throttle valve 21 and outputs a signal proportional to an intake air temperature AT to the ECU 30 through a signal line c.

An overheat sensor 34 is disposed at the exhaust manifold 25 and outputs a signal proportional to an engine exhaust temperature to the ECU 30 through a signal line d. Also, a wall temperature sensor 35 is disposed at an appropriate position of a nearby cylinder block as an engine temperature detector that detects a heating operation of the engine 1 and outputs a signal proportional to an engine cooling wall temperature WT to the ECU 30 through a signal line e.

An ISC (Idle Speed Control) valve 26 controls an amount of air to maintain an idle condition during an idle operation. An idle condition is maintained in a manner as follows. That is, when there is a need to increase an amount of air, the ISC valve 26 is moved in a contracting direction according to a STEP number reducing instruction to expand a space 27 so that an amount of incoming air increases. On the contrary, when an amount of air is reduced, the ISC valve 26 is moved in an extending direction according to a STEP number increasing instruction to fill the space 27 with the ISC valve 26 so that an amount of incoming air is reduced.

A shift position sensor (not shown) as a load detector that detects whether the engine 1 is shifted at the neutral, forward, or reverse position is disposed within a gear box 37 in the vicinity of the shift link mechanism and outputs a signal corresponding to the shifted position (forward/neutral/reverse) to the ECU 30 through a signal line f. An engine load is detected by this signal. Also, a crank angle sensor 36 functioning as an engine speed detector that detects an engine speed is disposed in the vicinity of a flywheel 28 attached to the gear box 37 via a crank shaft 5 and outputs a crank angle signal to the ECU 30 through a signal line g. The ECU 30 calculates an engine rotation speed (engine speed NE) on the basis of an output from the crank angle sensor 36.

An operation of the fuel injection control apparatus of the invention will now be described with reference to FIG. 1 and FIG. 2. The crank shaft 5 starts to rotate as the recoil starting device 15 is pulled manually. The power generator 44 driven by rotations of the crank shaft 5 thus generates power and generated power is supplied to the injector 23, a motorized fuel pump 41, and the like via the ECU 30. The motorized fuel pump 41 activated upon a supply of the power supplies the injector 23 with a fuel in a fuel tank 40 through a fuel pipe 43 as much as an amount of fuel calculated by the ECU 30. The fuel pump 41 has a fuel pressure regulation mechanism 42 and an excessive fuel is returned to the fuel tank 40 through a return pipe 45 to prevent a fuel pressure from exceeding a predetermined fuel pressure.

The ECU 30 drives the injector 23 according to a pre-computed amount of fuel supply and calculates an amount of fuel the engine 1 requires. In this manner, the ECU 30 drives the fuel pump 41 so as to control the motor speed in the fuel pump 41 to be a speed at which a target amount of fuel is supplied to the engine 1. It should be noted that the ECU 30 constantly detects an actual motor speed in the fuel pump 41 while it drives the fuel pump 41.

More specifically, a fuel pump driver IC in the ECU 30 is formed with a capability of detecting, in parallel with the driving of a pump motor, an actual speed of the pump motor the driver IC is driving. Then, because a signal made up of three pulses is generated per rotation of the motor, this signal is monitored by an internal CPU of the ECU 30 to compute a motor actual speed. For example, given 20 ms as a signal pulse interval, then 60 ms per rotation is obtained as the actual motor speed. In terms of rotation speed, the actual motor speed is 1000 r/min.

Figure 3:
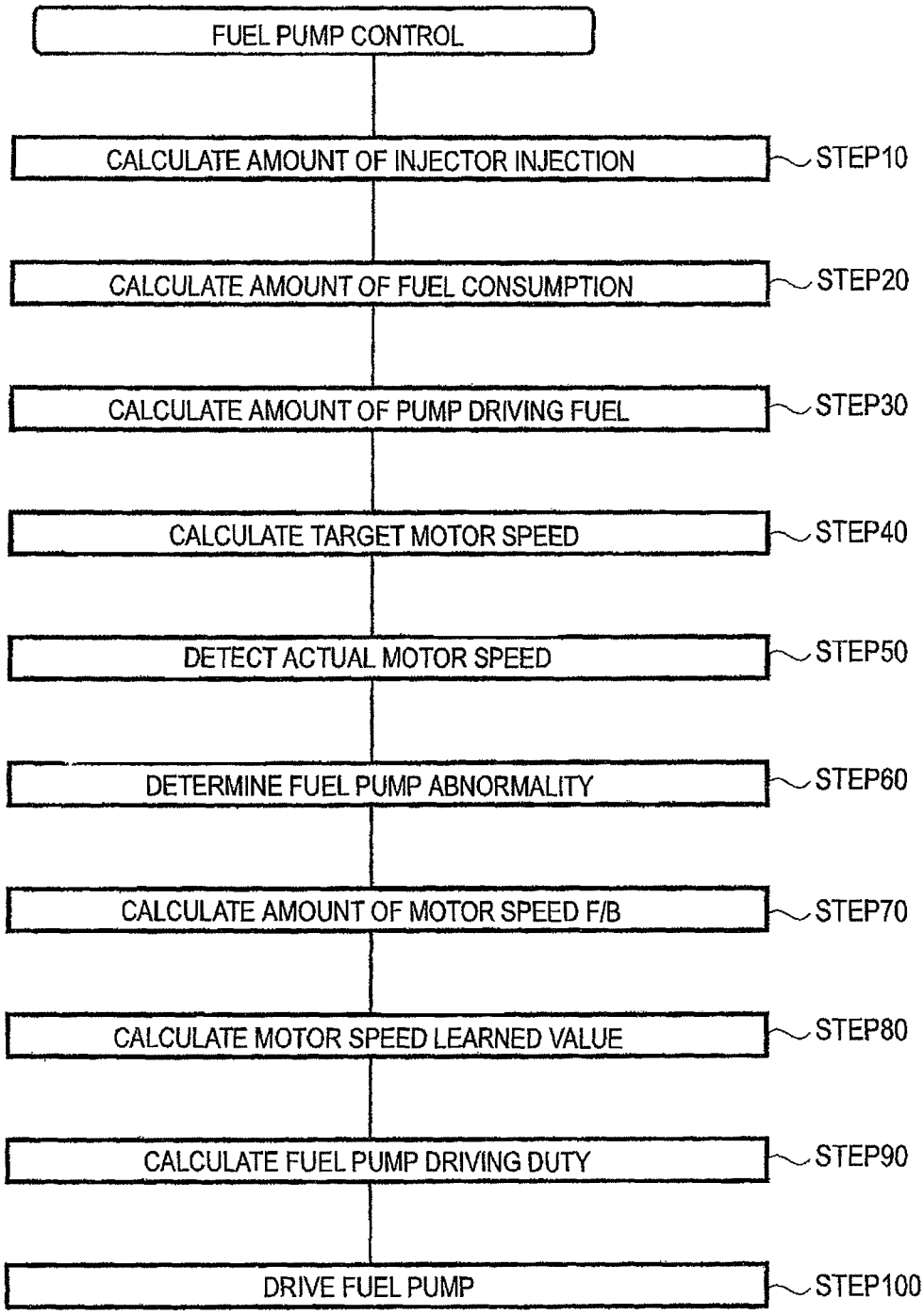
FIG. 3 is a flowchart depicting fuel pump control according to the first embodiment.
Figure 9:
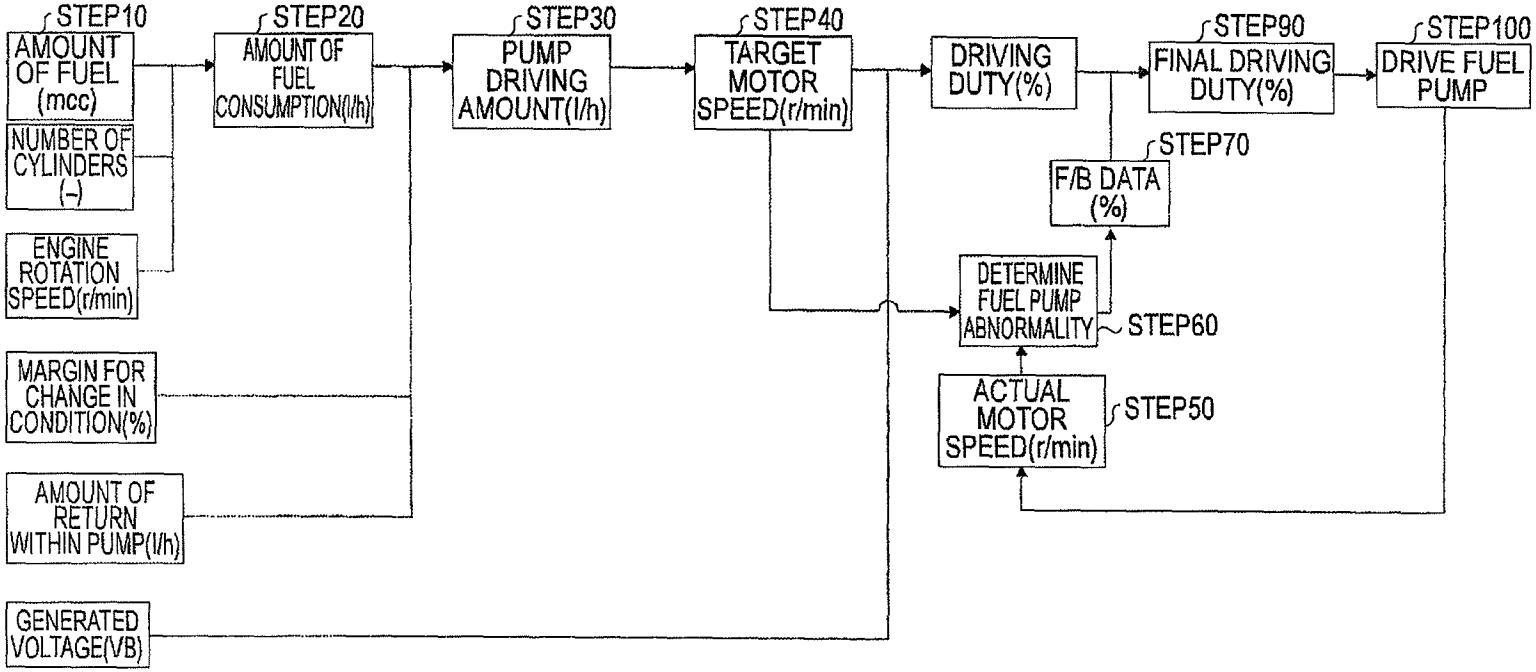
FIG. 9 is a step chart re-written from the flowchart of FIG. 3 for ease of understanding of connections among respective steps.

The fuel pump control carried out by the ECU 30 will now be described in detail in accordance with the flowchart shown in FIG. 3. FIG. 9 is a step chart re-written from the flowchart of FIG. 3 for ease of understanding of connections among respective steps. An operation as follows will be described with reference to the both drawings.

Firstly, in STEP 10, an amount air the engine 1 is taking in is calculated on the basis of data indicating an operation condition of the engine 1, such as an engine speed calculated on the basis of an output of the crank angle sensor 36, an absolute pressure in the inlet pipe 20, that is, an output of the absolute pressure sensor 32, and an engine wall temperature detected by the wall temperature sensor 35.

More specifically, an intake pressure is found for each crank angle sensor signal to obtain an average intake pressure. On the basis of the average intake pressure and the rotation speed, volume efficiency data is calculated by map interpolation computation using data preliminarily obtained by suitably setting volume efficiency values in map data. The calculated volume efficiency data is corrected with ambient pressure and a value equivalent to filling efficiency is found by taking air density and standard atmospheric density into account. An amount of intake air is calculated by multiplying the value equivalent to filling efficiency found as above by displacement data, the standard atmospheric density, and the rotation speed. An amount of fuel (mcc) comparable to the calculated amount of intake air is calculated as an amount of injector injection. This amount of injector injection is given to the injector 23 and an amount of fuel comparable to an amount of air the engine 1 is taking in is supplied to the engine 1 in sync with the engine speed. In this manner, the engine 1 is driven under control.

In STEP 20, an amount of fuel consumption (l) by the engine 1 per hour is calculated in accordance with an equation below on the basis of the amount of injector injection (mcc) found in STEP 10, the number of engine cylinders, and the engine speed:

amount of fuel consumption(*l/h*)=amount of injector injection(*mcc*)*the number of engine cylinders*engine speed(rpm)/120 (1).

In STEP 30, an amount of pump driving fuel (l/h) is calculated on the basis of the amount of fuel consumption (l/h) by the engine 1. The amount of fuel consumption is corrected by addition of a margin (for example, 120%) to compensate for a fuel shortage caused by a change in the engine operation condition, such as rapid acceleration. An amount of return (l/h) from the fuel pressure regulation mechanism 42 is added to the correction result to calculate an amount of pump driving fuel in accordance with an equation below. A predetermined amount of fuel due to the pump characteristics flows in the fuel pressure regulation mechanism 42 to raise and maintain a fuel pressure at a predetermined value:

amount of pump driving fuel=amount of fuel consumption(*l/h*)*margin allowed for change in condition(%)+amount of return within pump(*l/h*) (2).

Figure 6:
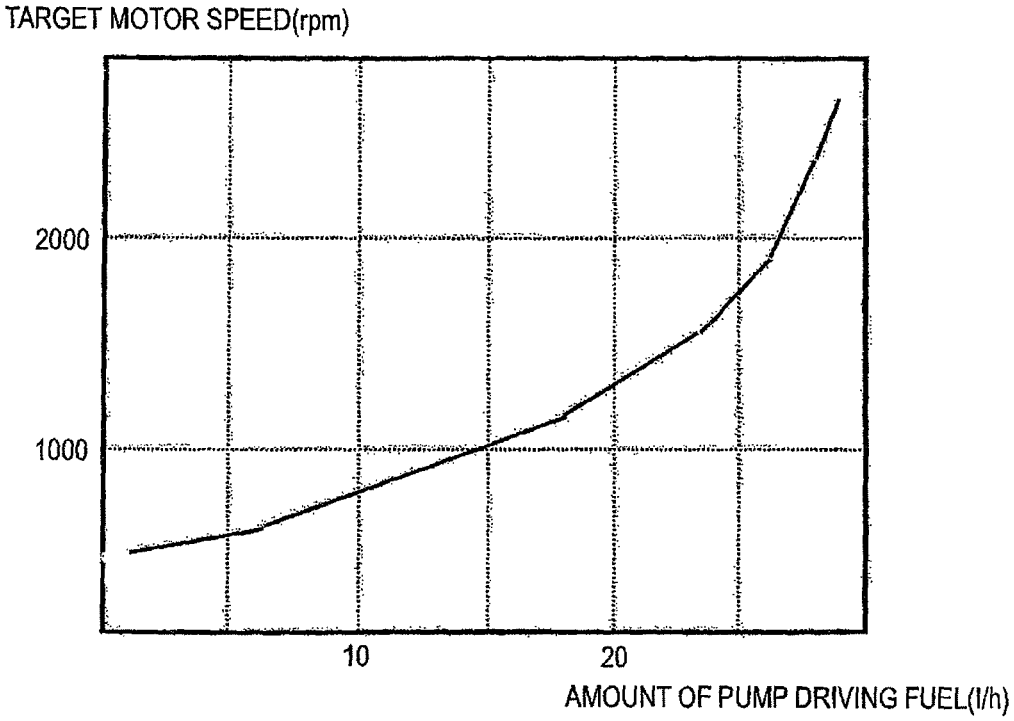
FIG. 6 is a characteristic chart of fuel pump characteristics data showing a relation between a motor speed and an amount of pump driving fuel.

In STEP 40, a target motor speed is found by interpolation computation using the amount of pump driving fuel as a parameter on the basis of fuel pump characteristics data (see FIG. 6) pre-set as map data in the ECU 30. By controlling the motor speed of the fuel pump 41 to be maintained at the value of the target motor speed, it becomes possible to supply an amount of fuel the engine 1 requires by the fuel pump 41.

In STEP 50, the motor speed of the fuel pump 41 is constantly measured in parallel with the driving of the fuel pump 41. The motor speed thus measured is given as the actual motor speed.

Figure 4:
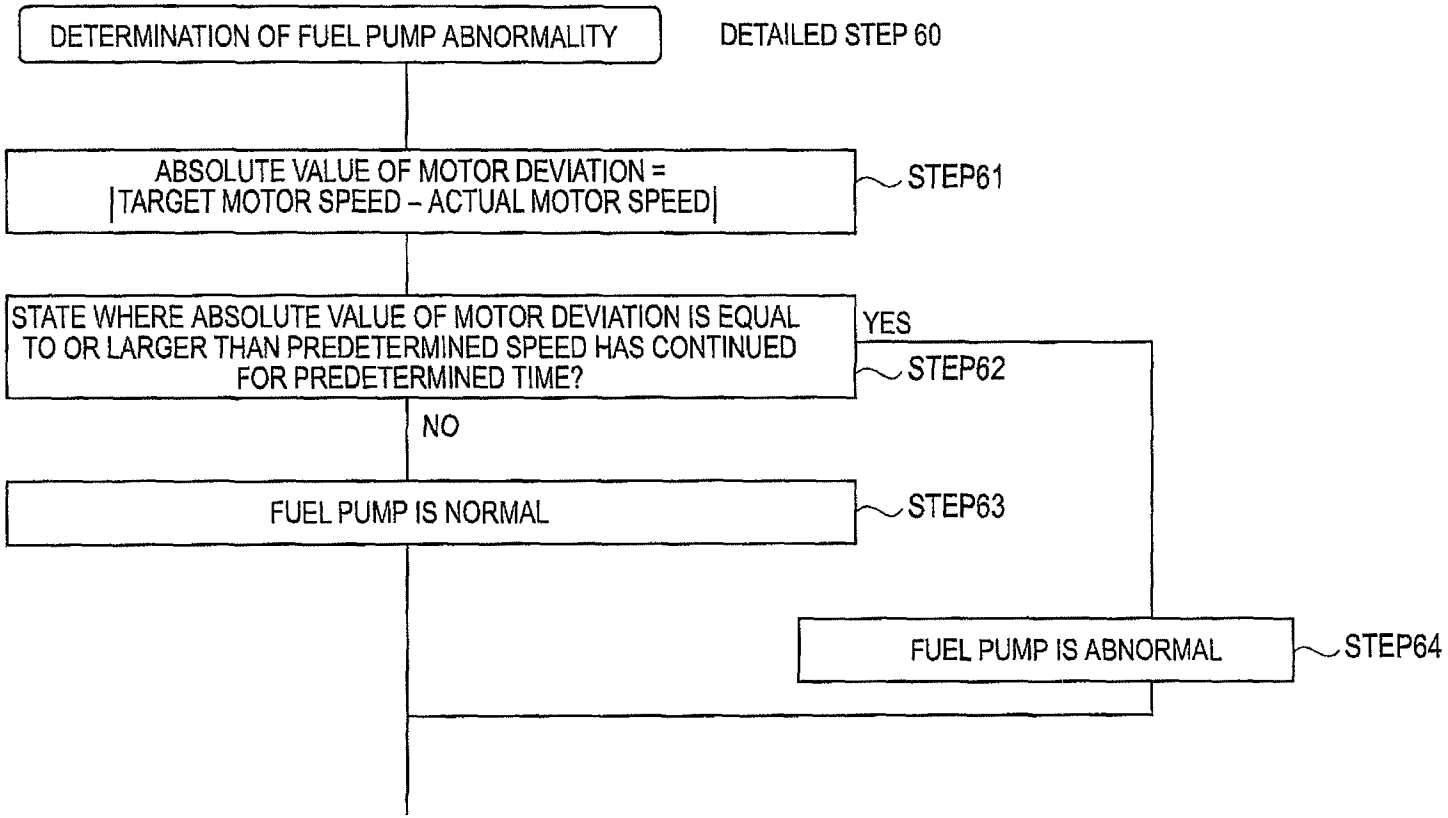
FIG. 4 is a view detailing a fuel pump abnormality determination in STEP 60 in the flowchart of FIG. 3.

In STEP 60, an abnormality of the fuel pump apparatus is detected on the basis of a deviation between the target motor speed and the actual motor speed while the fuel pump 41 is driven. A fuel pump abnormality determination step will now be described in detail with reference to FIG. 4. Referring to FIG. 4, the absolute value of a deviation between the target motor speed and the actual motor speed is calculated in STEP 61. In STEP 62, whether the motor deviation absolute value calculated in STEP 61 lasts for a predetermined time (seconds) or longer at or above a predetermined value (rpm). When the condition as above is satisfied, the flow proceeds to STEP 64 where a fuel pump abnormality is determined. Thereafter, a determination in STEP 62 is stopped and an abnormal condition is stored in the ECU 30 while a fuel pump abnormal condition continues. When the condition as above is not satisfied, the flow proceeds to STEP 63 and the fuel pump 41 is determined as being normal.

Figure 5:
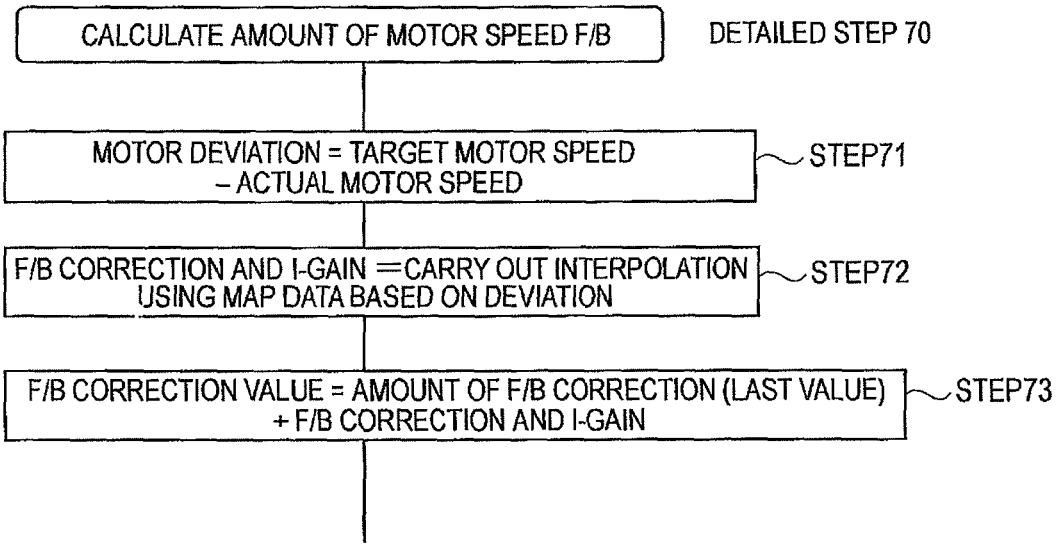
FIG. 5 is a view detailing a calculation of an amount of motor speed F/B correction in STEP 70 in the flowchart of FIG. 3.
Figure 7:
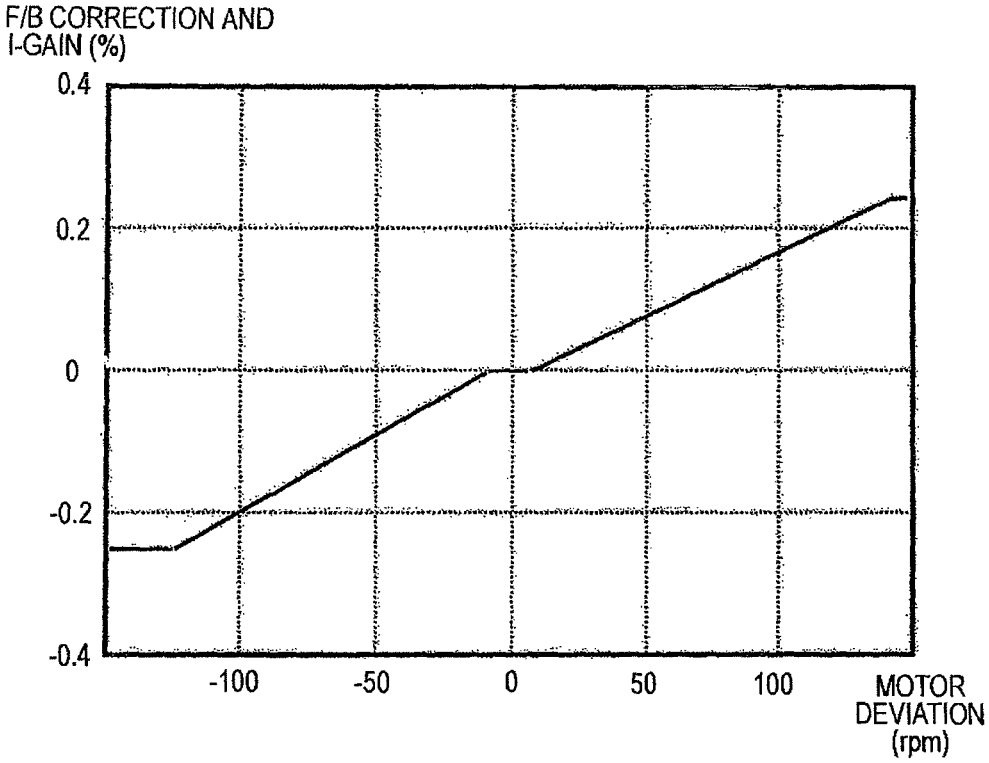
FIG. 7 is a characteristic chart of F/B correction and I-gain map data showing a relation between a deviation and a gain.
Figure 8:
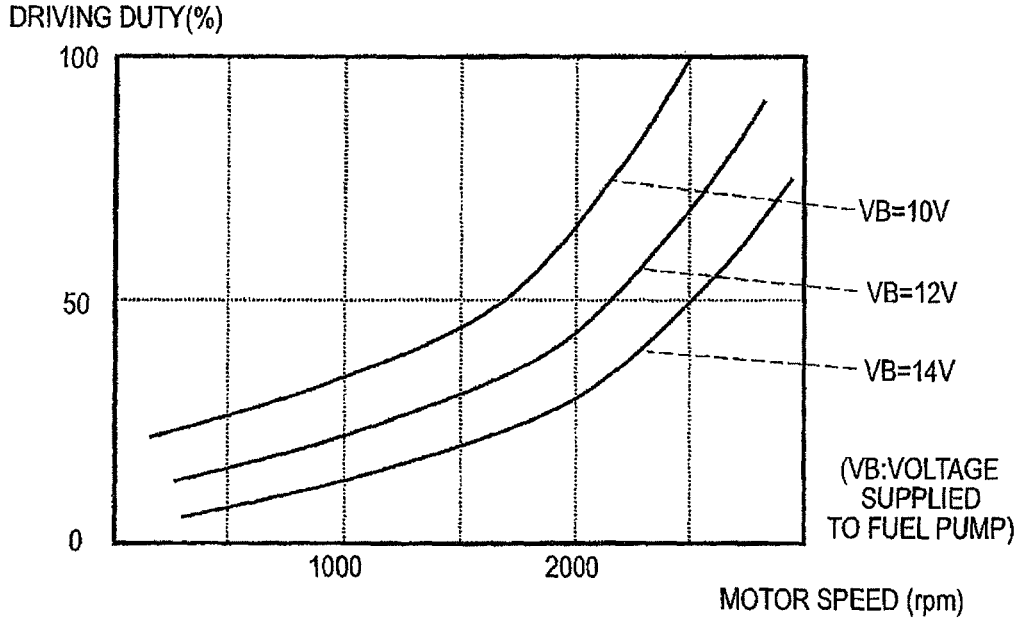
FIG. 8 is a characteristic chart of fuel pump duty characteristics data showing a relation between a motor speed and driving duty for various operation voltages.

In a case where the fuel pump 41 is normal, an amount of motor speed F/B is calculated in STEP 70, which is not carried out in a case where an abnormality is determined. A calculation step of an amount of motor speed F/B will now be described in detail with reference to FIG. 5. In STEP 71, a deviation between the target motor speed and the actual motor speed is calculated. In STEP 72, a F/B correction value correcting fuel pump driving duty so as to eliminate the deviation is calculated. FIG. 7 shows F/B correction and I-gain map data on the basis of which F/B correction and I-gain are found by interpolation calculation using the deviation as a parameter. The purpose of this calculation is to absorb a change of the fuel pump duty characteristics (see FIG. 8) caused by irregularities among parts, a temperature, and endurance deterioration of the fuel pump 41.

To be more specific, because the motor speed varies dependently to a driving current, the motor speed varies with a change of the driving voltage even when the duty ratio is the same. Also, the motor speed varies with a change of a resistance value of the motor. The resistance value of the motor increases as the temperature rises. Accordingly, even when the driving duty is the same, the resistance value increases whereas the driving current decreases as the temperature rises. Consequently, because the motor speed slows down, it becomes necessary to absorb such a variance by the F/B of the motor speed.

A deviation between the target rotation speed and the actual rotation speed of the fuel pump 41 is found in STEP 71 and it can be determined that there is a considerable gap between the target rotation speed and the actual rotation speed in STEP 72 when the deviation is large. Accordingly, end data (large gain) of the FIB correction and I-gain map data of FIG. 7 is reflected on the F/B correction value. In a case where the deviation is small, central data (small gain) of the F/B correction and I-gain map of FIG. 7 is used and reflected on the F/B correction value. In a case where the deviation is large, the deviation is lessened in the next determination owing to the F/B correction and a change of the fuel pump duty characteristics caused by irregularities among parts, a temperature, and endurance deterioration of the fuel pump 41 is eventually absorbed while the processing as above is repetitively carried out.

In STEP 73, a F/B correction value is calculated by adding up the F/B correction and the I-gain. It should be noted, however, that F/B correction value=0(%) is given in a case where a fuel pump abnormality is determined.

In Step 80, in a case where a state in which the engine operation condition is stable for a predetermined time or longer and the F/B correction value is stable without yielding a deviation between the motor speeds for the predetermined time or longer, the F/B correction value is learned and stored in a memory region in the ECU 30 at every predetermined time or every predetermined fuel pump rotation speed. Accordingly, when the controller is activated next time, the controller starts the control by correcting the fuel pump driving duty with the stored learned data in addition to the F/B correction value. A motor speed learned value calculated on the basis of the F/B correction value is calculated in accordance with an equation below. Herein, F/B correction value=0 (%) is given after the learned value is calculated and updating of the learned value is inhibited when a fuel pump abnormality is determined. Also, upper and lower limit clip values are set for the motor speed learned value to be clipped at the upper or lower limit. When the learned value has already reached the upper or lower limit value and is clipped at the upper or lower limit after all whether the learned value is updated or not, the learning processing is inhibited.

$$\text{motor speed learned value}(\%)=\text{motor speed learned value(last value)}+F/B\text{ correction value} \quad (3)$$

In STEP 90, a basic fuel pump driving amount (%) is calculated on the basis of the fuel pump duty characteristics map data (FIG. 8) using the target motor speed as a parameter to calculate fuel pump driving duty in accordance with the following computation:

$$\text{fuel pump driving duty}(\%)=\text{basic fuel pump driving amount}(\%)+F/B\text{ correction value}+\text{motor speed learned value} \quad (4).$$

Finally in STEP 100, the fuel pump 41 is driven under control according to the fuel pump driving duty obtained in accordance with Equation (4) above.

As has been described, the fuel pump control apparatus of an engine of the invention carries out F/B control according to a deviation between the target motor speed and the actual motor speed of the fuel pump by driving the fuel pump suitably to an amount of fuel on the basis of an amount of fuel consumed by the engine and by monitoring the actual motor speed of the fuel pump and thereby correcting the duty driving of the fuel pump to suit the engine condition. An amount of required fuel belongs to the engine characteristics whereas the duty data according to which to drive the pump belongs to the pump characteristics. Hence, by setting the former and the latter separately, setting points of data involved in the fuel pump characteristics can be divided. It thus becomes unnecessary to set new data even when the fuel pump is used in another engine system.

Various modifications and alterations of this invention will be apparent to those skilled in the art without departing from the scope and spirit of this invention, and it should be understood that this is not limited to the illustrative embodiments set forth herein.

What is claimed is:

1. A fuel pump control apparatus of an engine, comprising:

an operation condition detection portion that detects an operation condition of the engine;

a motorized fuel pump furnished with a fuel pressure regulation function;

an injector that supplies the engine with fuel according to a fuel pressure supplied from the motorized fuel pump;

a power generation portion that generates power by manual rotational driving of a crank shaft of the engine; and a control portion that is activated by a voltage generated by the power generation portion and computes an amount of fuel to be injected and calculates a fuel pump driving duty according to a detected value from the operation condition detection portion, wherein the control portion includes:

an injector injection amount calculation functioning portion that calculates an amount of injector injection to be supplied to the engine according to the operation condition of the engine;

a fuel consumption amount calculation functioning portion that calculates an amount of fuel the engine is consuming on a basis of the amount of injector injection, a number of cylinders of the engine, and an engine rotation speed of the engine;

a pump driving fuel amount calculation functioning portion that calculates an amount of fuel to drive the motorized fuel pump on a basis of an output of the fuel consumption amount calculation functioning portion;

a target motor speed calculation functioning portion that calculates a target motor speed on a basis of an output of the pump driving fuel amount calculation functioning portion;

a driving duty calculation functioning portion that calculates the fuel pump driving duty indicating time periods during which the motorized fuel pump is driven, on a basis of an output of the target motor speed calculation functioning portion; and a feedback (F/B) correction value calculation functioning portion that finds a deviation between an actual motor speed detected from the motorized fuel pump and the target motor speed and calculates a F/B correction value of the fuel pump driving duty so that the deviation is eliminated, wherein:

in a case where a state in which the operation condition of the engine is stable for a predetermined time period or longer and the F/B correction value is stable without yielding the deviation between the actual motor speed and the target motor speed for the predetermined time period or longer, the control portion learns the F/B correction value and stores the F/B correction value in a memory region in the control portion, so that when the control portion is activated a next time after the predetermined time period elapses, the control portion starts control by correcting the fuel pump driving duty with the stored, learned F/B correction value in addition to a subsequent F/B correction value calculated when the control portion is activated the next time.

2. The fuel pump control apparatus of an engine according to claim 1, wherein:

in a case where a state in which the deviation between the target motor speed and the actual motor speed while a fuel pump rotation speed is controlled is equal to or larger than a parameter value pre-set in a memory region of the control portion has continued for a predetermined time period or longer, presence of an abnormality in the fuel pump control apparatus is determined and the abnormality in the fuel pump control apparatus is confirmed and stored in the control portion; and the F/B correction value of a pump speed is stopped to carry out control thereafter according to the target motor speed calculated in the control portion and learned data stored therein.

* * * * *